US009121568B2

(12) United States Patent
Aoyama et al.

(10) Patent No.: US 9,121,568 B2
(45) Date of Patent: Sep. 1, 2015

(54) LIGHTING DEVICE

(75) Inventors: Tomoya Aoyama, Kanagawa (JP); Satoshi Seo, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 272 days.

(21) Appl. No.: 13/289,616

(22) Filed: Nov. 4, 2011

(65) Prior Publication Data

US 2012/0113632 A1 May 10, 2012

(30) Foreign Application Priority Data

Nov. 5, 2010 (JP) ..... 2010-249199

(51) Int. Cl.

| | |
|---|---|
| ***F21V 9/00*** | (2006.01) |
| ***F21V 7/00*** | (2006.01) |
| *F21Y 101/02* | (2006.01) |
| *F21Y 105/00* | (2006.01) |

(52) U.S. Cl.

CPC ..... *F21V 7/00* (2013.01); *F21Y 2101/02* (2013.01); *F21Y 2105/008* (2013.01)

(58) Field of Classification Search

CPC .. F21V 7/00; F21Y 2105/008; F21Y 2101/02
USPC ..... 362/230–235, 239, 84, 602
See application file for complete search history.

(56) References Cited

U.S. PATENT DOCUMENTS

| | | | | |
|---|---|---|---|---|
| 8,791,633 | B2 * | 7/2014 | Diekmann et al. | 313/512 |
| 2005/0169012 | A1 * | 8/2005 | Takeuchi | 362/602 |
| 2005/0248935 | A1 | 11/2005 | Strip et al. | |
| 2006/0027781 | A1 | 2/2006 | Dong et al. | |
| 2008/0007936 | A1 * | 1/2008 | Liu et al. | 362/84 |
| 2008/0094004 | A1 | 4/2008 | Ackermann | |
| 2008/0261075 | A1 | 10/2008 | Seo et al. | |
| 2010/0237774 | A1 | 9/2010 | Yamazaki et al. | |
| 2010/0244672 | A1 | 9/2010 | Nomura et al. | |
| 2011/0215714 | A1 | 9/2011 | Seo et al. | |
| 2012/0077987 | A1 | 3/2012 | Osaka et al. | |
| 2012/0097982 | A1 | 4/2012 | Wakimoto et al. | |

FOREIGN PATENT DOCUMENTS

| | | |
|---|---|---|
| JP | 7-199824 | 8/1995 |
| JP | 2002-100229 | 4/2002 |
| JP | 2007/5228 | 1/2007 |
| JP | 2008-512837 | 4/2008 |
| JP | 2009-146741 A | 7/2009 |
| WO | WO 2009/016604 A1 | 2/2009 |

* cited by examiner

*Primary Examiner* — Anh Mai
*Assistant Examiner* — Jessica M Apenteng
(74) *Attorney, Agent, or Firm* — Husch Blackwell LLP

(57) ABSTRACT

A lighting device with high emission efficiency and directivity is provided with the use of an organic EL element and a light-emitting diode. The lighting device includes a light-emitting diode whose emission wavelength peak is greater than or equal to 400 nm and less than or equal to 500 nm, a planar organic EL light-emitting body which emits light having a complementary color of that of light from the light-emitting diode, and a planar reflector. The organic EL light-emitting body and the reflector face each other to form a cone having an open end to which light is emitted. The light-emitting diode is provided in a space between a plane including a light-emitting surface of the organic EL light-emitting body and a plane including a reflecting surface of the reflector.

18 Claims, 7 Drawing Sheets

LIGHTING DEVICE

BACKGROUND OF THE INVENTION

1. Field of the Invention

The present invention relates to a lighting device, for example, a lighting device which emits light by luminescence.

2. Description of the Related Art

In recent years, light-emitting devices including organic electroluminescence (hereinafter also referred to as EL) elements as self-luminous elements have been actively researched. In the basic structure of an organic EL element, a layer including a light-emitting organic compound (hereinafter referred to as a light-emitting layer) is provided between a pair of electrodes. By voltage application to this element, light emission from the light-emitting organic compound can be obtained.

Since an organic EL element can be formed in a film form, planar light emission can be easily obtained. This is a feature which is difficult to obtain in point light sources typified by an incandescent lamp, or line light sources typified by a fluorescent lamp and the like. Specifically, since an organic EL element is a surface light source, lighting with less glare of the light source which enters the field of view can be provided.

In an organic EL element, a plurality of light-emitting layers are provided and light is emitted from each light-emitting layer, whereby light emission in which plural types of light emission are mixed can be obtained. For example, light-emitting layers which emit light of respective colors of red, green, and blue, or light-emitting layers which emit light of complementary colors are overlapped with each other (or stacked), whereby an organic EL element which emits white light can be obtained.

A lighting device including an organic EL element, which makes use of these characteristics, is disclosed (see Patent Document 1).

As a technique which is often compared with an organic EL element, an LED (also referred to as a light-emitting diode) can be given. An LED is a point light source having high directivity. In recent years, an LED has been showing rapid growth in market share for lighting owing to a significant increase in a lifetime. Some LED lamps have a lifetime of more than a hundred thousand hours and such LED lamps are employed for traffic lights, streetlights, and the like to make use of the characteristic of resistance for long-term use. Accordingly, the frequency of replacement of a lamp is significantly reduced, which leads to drastic retrenchment, conservation of resources, and the like. Note that an LED in this specification refers to, in particular, a point light emitting element among semiconductor elements which emit light when forward voltage is applied.

There are a variety of methods of manufacturing white lighting using an LED. As a device structure which has been mainly considered, a structure in which a blue LED and a phosphor emitting yellow light or the like are combined can be given. In this structure, the phosphor is provided around the blue LED. A white light source is realized by a mixture of light: light obtained when the phosphor absorbs light from the blue LED and performs conversion, and blue light which passes through the phosphor without being absorbed (see Patent Document 2).

REFERENCE

Patent Document

[Patent Document 1] U.S. Published Patent Application No. 2005/0248935

[Patent Document 2] U.S. Published Patent Application No. 2006/0027781

SUMMARY OF THE INVENTION

However, emission efficiency of an organic EL element which emits blue light is lower than that of an organic EL element which emits red or green light, and a blue organic EL element with sufficient characteristics needed for a lighting device has not been realized. On the other hand, a structure in which a blue LED and a phosphor emitting yellow light are combined, which is a general structure of white lighting using an LED, converts blue light having high energy into yellow light having low energy, and thus energy efficiency is low. Accordingly, it is difficult to manufacture white lighting with high efficiency with the use of only an organic EL element or an LED.

Further, since an organic EL element is a surface light source, driving current is increased or the emission area is widened to increase luminous flux, in the case where bright, lighting is needed. However, in the case of this method, an organic EL element, which is a surface light source, is unsuitable for a lighting device used as partial lighting which illuminates only a necessary region while directivity is increased without increasing power consumption, such as a table lamp and a spotlight, because there is light which leaks to the outside of a surface to be illuminated.

The present invention is made in view of the foregoing technical background. Thus, an object of one embodiment of the present invention is to provide a lighting device with high emission efficiency and directivity.

In order to achieve the above object, one embodiment of the present invention focused on a structure in which both light-emitting bodies of an organic EL element and an LED are combined. Mixture of light from a blue LED and light from an organic EL element allows manufacture of a lighting device with high emission efficiency.

A conical body with an open end is formed using an organic EL light-emitting body with an organic EL element provided over a substrate and a reflector which faces the organic EL light-emitting body and reflects light. An LED is provided in the inside of the conical body. With a conical structure, light which leaks from the organic EL light-emitting body to the outside of a surface to be illuminated can be converged on the surface to be illuminated and thus, a lighting device with directivity can be provided.

Further, light from the organic EL light-emitting body and light from the LED are reflected by the reflector, are mixed, and then enter a surface to be illuminated, whereby lighting in which light from the organic EL light-emitting body, which is a surface light source, and light from the LED, which is a point light source, are mixed can be obtained.

That is, one embodiment of the present invention is a lighting device including a light-emitting diode whose emission wavelength peak is greater than or equal to 400 nm and less than or equal to 500 nm, a planar organic electroluminescence light-emitting body which emits light having a complementary color of that of light from the light-emitting diode, and a planar reflector. The planar organic electroluminescence light-emitting body and the planar reflector face each other to form a cone having at least one open end to which light is emitted. The light-emitting diode is provided in a space between a surface including a light-emitting surface of the planar organic electroluminescence light-emitting body and a surface including a reflecting surface of the planar reflector. Light from the light-emitting diode is emitted to the planar organic electroluminescence light-emitting body, the planar reflector, or the surface to be illuminated.

According to one embodiment of the present invention, light emitted from the organic electroluminescence light-emitting body and light emitted from the light-emitting diode are mixed and enter the surface to be illuminated; thus, white light emission can be obtained. Further, since blue light emission from the organic electroluminescence light-emitting body is supplemented by light emission from the light-emitting diode, a lighting device with high emission efficiency can be obtained.

In addition, since the reflector which is provided to face the organic electroluminescence light-emitting body reflects light from the organic electroluminescence light-emitting body and the light is converged on the surface to be illuminated, light which leaks from the organic electroluminescence light-emitting body to the outside of the surface to be illuminated is converged on the surface to be illuminated; thus, a lighting device with directivity can be provided.

Furthermore, it is preferable that an organic electroluminescence light-emitting body have a function of reflecting light from a light-emitting diode because the convergence property is improved.

One embodiment of the present invention is a lighting device in which a reflector may be provided with an organic electroluminescence element. The reflector also serves as a light source, so that the emission area is increased; thus, a lighting device with high illuminance can be provided.

One embodiment of the present invention is a lighting device in which a light-emitting diode may be provided on a non-light-emitting region of an organic electroluminescence light-emitting body. As a result, light from the organic electroluminescence light-emitting body is not blocked by the light-emitting diode and thus, a lighting device with high efficiency can be provided.

An organic electroluminescence light-emitting body included in a lighting device according to one embodiment of the present invention may be provided with a reflective electrode having a visible light reflectance of 60% or more. Thus, the reflection efficiency of the organic electroluminescence light-emitting body is increased and as a result, a lighting device with a higher convergence property can be provided.

A light-emitting diode included in a lighting device according to one embodiment of the present invention may emit light to a reflector or an organic electroluminescence light-emitting body. Thus, a lighting device according to one embodiment of the present invention has characteristics that light from an LED with high directivity does not directly enter eyes and glare due to light can be decreased even when the light is seen directly.

According to one embodiment of the present invention, an organic electroluminescence light-emitting body may have unevenness in a surface through which light is extracted. Thus, light extraction efficiency of the organic electroluminescence light-emitting body is increased and as a result, a lighting device with higher efficiency can be provided.

According to one embodiment of the present invention, an organic electroluminescence light-emitting body may have a dielectric mirror on a surface through which light is extracted. The dielectric mirror has functions of reflecting light from a light-emitting diode and transmitting light from the organic electroluminescence light-emitting body. Thus, when the organic electroluminescence light-emitting body reflects light from the light-emitting diode, the light from the light-emitting diode does not pass through an organic electroluminescence element. Accordingly, attenuation of light is reduced and thus, a lighting device with higher efficiency can be provided.

In this specification, a conical body refers to a cone or a pyramid such as a triangular pyramid, a square pyramid, or a pentagonal pyramid. The base of a conical body has an opening. The perpendicular line of the base passes the center point of the base and a vertex facing the base. The perpendicular line which passes the center point of the base is referred to as a first axis of a lighting device while the direction to which an LED included in the lighting device emits light is referred to as a second axis of the lighting device.

Solids each obtained by cutting a part from a conical body, such as a frustum of a cone, a frustum of a triangular pyramid, a frustum of a square pyramid, and a frustum of a pentagonal pyramid are also included in conical bodies.

The term "the inside of a/the conical body" refers to a space surrounded by the side and the base of the conical body. Note that in a solid obtained by cutting a part from a conical body, a space surrounded by the side and the base of a conical body before the part of the conical body is cut is included in the term "the inside of a/the conical body". The inner side surface and the inner base surface of the conical body are included in the inside of a conical body.

Note that a plane which is parallel to the base of a conical body and which is provided in the direction to which a lighting device emits light is referred to as a surface to be illuminated. A lighting device according to one embodiment of the present invention emits white light to part of the surface to be illuminated.

One embodiment of the present invention can provide a lighting device with high emission efficiency and directivity.

DETAILED DESCRIPTION OF THE INVENTION

Figure 1A:
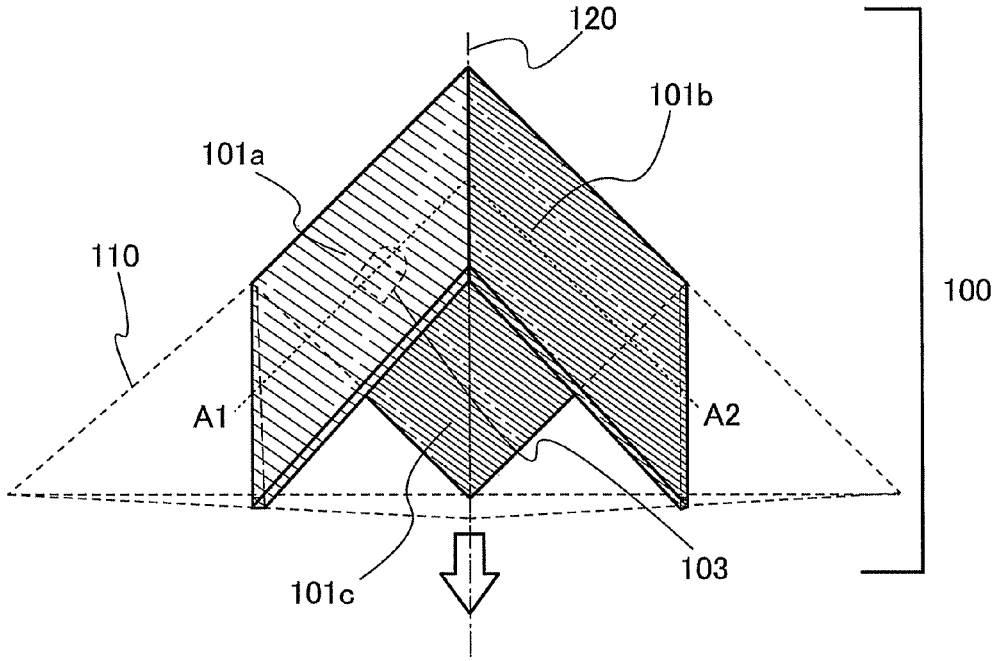
FIG. 1A is a perspective view of a lighting device according to one embodiment of the present invention and FIG. 1B is a cross-sectional view thereof.

Embodiments will be described in detail with reference to the drawings. However, the present invention is not limited to the following description and a variety of changes for the modes and details thereof will be apparent to those skilled in the art unless such changes depart from the spirit and the scope of the invention. The present invention should not be construed as being limited to the following description. In the structures of the invention to be given below, the same portions or portions having similar functions are denoted by the same reference numerals in different drawings, and explanation thereof will not be repeated.

Embodiment 1

In this embodiment, a structure of a white lighting device and a method of manufacturing the white lighting device according to one embodiment of the present invention will be described with reference to FIGS. 1A and 1B, FIGS. 2A to 2C, FIGS. 4A to 4C, FIG. 6, and FIGS. 7A to 7C.

The white lighting device according to one embodiment of the present invention includes an organic EL light-emitting body, a reflector, and an LED. Specifically, the LED is provided in the inside of a conical body which is formed by directly connecting the organic EL light-emitting body to the reflector.

A white lighting device 100 in FIG. 1A includes a reflector 101*a*, organic EL light-emitting bodies 101*b* and 101*c*, and an LED 103.

First, the LED, the organic EL light-emitting body, and the reflector which are included in the white lighting device according to one embodiment of the present invention are specifically described.

The emission wavelength peak of the LED included in the white lighting device according to one embodiment of the present invention is greater than or equal to 400 nm and less than or equal to 500 nm. An LED whose emission wavelength peak is in the above wavelength range has high energy; thus, high emission efficiency can be achieved. Although a white lighting device including one LED is described as an example in this embodiment, a white lighting device may include two or more LEDs.

The emission intensity of the organic EL light-emitting body and the LED may be set as appropriate such that mixed light is white on a surface to be illuminated.

The organic EL light-emitting body included in the white lighting device according to one embodiment of the present invention includes a pair of electrodes and an organic EL element having at least a light-emitting layer. The emission color of the organic EL light-emitting body is a complementary color of the emission color of the LED.

The organic EL light-emitting body preferably includes an electrode (hereinafter referred to as a reflective electrode) which has a high visible light reflectance. Since the reflective electrode included in the organic EL light-emitting body can reflect light from the LED or light from another organic EL light-emitting body, the light from another organic EL light-emitting body or the light from the LED can be reflected and efficiently converged on a surface to be illuminated.

Thus, the visible light reflectance of the reflective electrode included in the organic EL light-emitting body is preferably 60% or more. When the reflectance of the reflective electrode included in the organic EL light-emitting body is sufficiently increased, light emitted from another organic EL light-emitting body or the LED can be reflected; thus, emission efficiency can be increased.

The organic EL light-emitting body may have unevenness in a surface through which light is extracted. With an uneven surface, light extraction efficiency of the organic EL light-emitting body is increased and thus, a lighting device with higher efficiency can be obtained.

Note that methods of manufacturing the organic EL light-emitting body and the organic EL element included in the organic EL light-emitting body will be described in detail in Embodiment 3 and Embodiment 4.

The reflector included in the white lighting device according to one embodiment of the present invention has a function of reflecting light from the organic EL light-emitting body and the LED. Specifically, the reflector contains one or more reflective materials which reflect visible light with a wavelength of greater than or equal to 400 nm and less than or equal to 800 nm. As the reflective material, for example, a metal plate containing one or more metal materials of aluminum, gold, platinum, silver, nickel, tungsten, chromium, molybdenum, iron, cobalt, copper, palladium, and the like can be used. Alternatively, a stacked structure of reflective films formed using a metal film containing the above metal material, a mirror, a metal half mirror, a dielectric mirror, or the like can be used. In addition, the organic EL light-emitting body can be used as the reflector. In particular, in the case where the organic EL light-emitting body is used as the reflector, the visible light reflectance of the reflective electrode included in the organic EL light-emitting body is preferably 60% or more.

When the organic EL light-emitting body is used as the reflector, the emission area is widened and luminous flux of the lighting device can be increased. Thus, the area of the organic EL light-emitting body may be adjusted in accordance with desired luminous flux for the lighting device.

The emission intensity of the organic EL light-emitting body and the LED may be set as appropriate such that mixed light is white on a surface to be illuminated.

Next, arrangements of the organic EL light-emitting body and the reflector will be described with reference to FIGS. 1A and 1B.

FIG. 1A is a perspective view of the white lighting device described in this embodiment. FIG. 1B is a cross-sectional view taken along a dotted line A1-A2 in FIG. 1A.

Each of the reflector 101*a* and the organic EL light-emitting bodies 101*b* and 101*c* forms a surface of a solid in which three parts each including a top of the base of a triangular pyramid 110 are cut from the triangular pyramid 110. A straight line which passes the center point of the base of the triangular pyramid 110 and a vertex facing the base is referred to as a first axis 120 of the white lighting device. The white lighting device 100 emits light to the direction along the first axis 120. The first axis 120 of the white lighting device is orthogonal to the base of the triangular pyramid 110 and the surface to be illuminated, which is parallel to the base of the triangular pyramid 110.

As illustrated in FIG. 1A, the organic EL light-emitting bodies 101*b* and 101*c* are provided to be inclined from the first axis 120 of the white lighting device. The reflector 101*a* is provided so that light from the organic EL light-emitting bodies 101*b* and 101*c* is reflected. As illustrated in FIG. 1B, in the white lighting device 100, the reflector 101*a* and the organic EL light-emitting body 101*b* are fixed so as to form an angle of 90°.

Here, an angle between the organic EL light-emitting body and the reflector will be described.

Figure 2A:
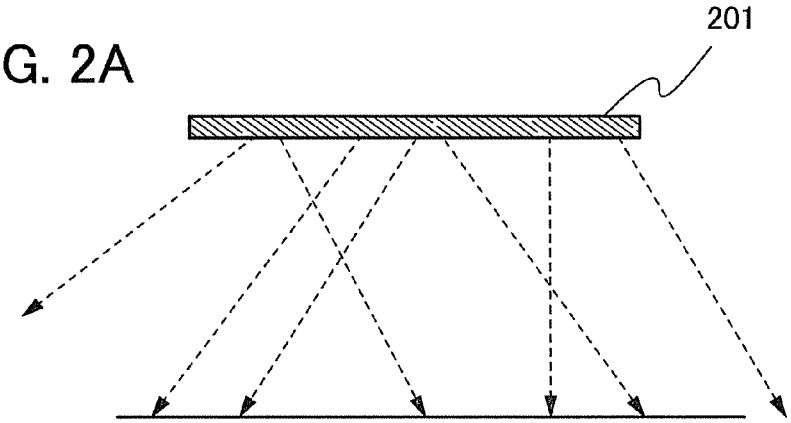
FIGS. 2A to 2C are views illustrating angles between an organic EL light-emitting body and a reflector.

Normally, the organic EL light-emitting body emits light to a variety of directions as illustrated in FIG. 2A. Accordingly, there is light which leaks to the outside of the surface to be illuminated when an organic EL light-emitting body 201 is provided in parallel to the surface to be illuminated so as to face each other.

Figure 2B:
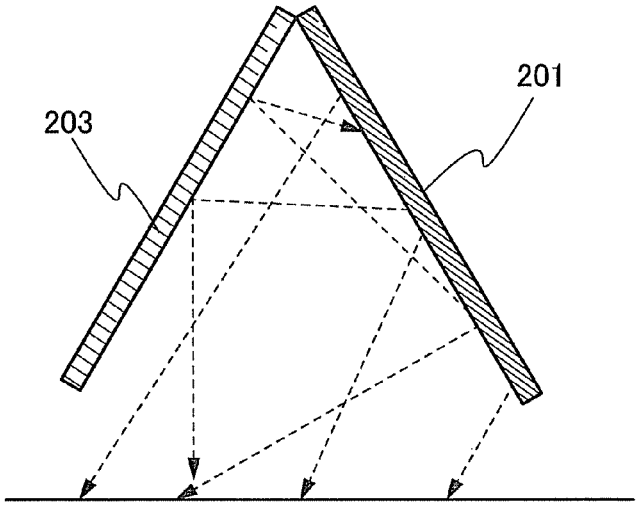
Figure 2C:
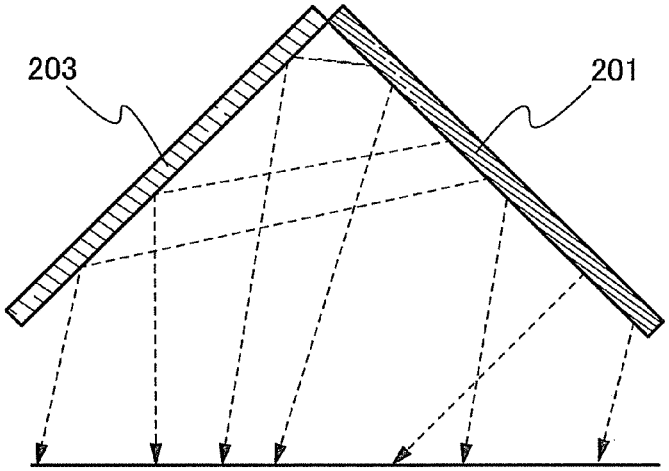

Thus, as illustrated in FIGS. 2B and 2C, the organic EL light-emitting body 201 is provided to be inclined from the surface to be illuminated and a reflector 203 which reflects light from the organic EL light-emitting body 201 toward the surface to be illuminated is provided, whereby light from the organic EL light-emitting body 201 is reflected toward the surface to be illuminated and light which leaks to the outside of the surface to be illuminated can also be converged on the surface to be illuminated.

Specifically, the angle between the organic EL light-emitting body and the reflector may be greater than 0° and less than 180°. With the combination of the organic EL light-emitting body and the reflector, light from the organic EL light-emitting body is reflected by the reflector toward the surface to be illuminated and thus, the light from the organic EL light-emitting body can be converged.

It is preferable that the angle between the organic EL light-emitting body and the reflector be greater than or equal to 90° and less than or equal to 150°. When the angle between the organic EL light-emitting body 201 and the reflector 203 is less than 90° as illustrated in FIG. 2B, part of light emitted from the organic EL light-emitting body 201 is reflected by the reflector 203 and then enters not the surface to be illuminated but the organic EL light-emitting body 201 in some cases. On the other hand, when the angle between the organic EL light-emitting body 201 and the reflector 203 is greater than or equal to 90° and less than 180° as illustrated in FIG. 2C, reflection of light from the organic EL light-emitting body 201 by the reflector 203 toward the organic EL light-emitting body 201 can be suppressed. Accordingly, light loss caused by such reflection is reduced and a convergence property can be improved.

However, when the angle between the organic EL light-emitting body and the reflector is too wide, the amount of light which enters the reflector among light from the organic EL light-emitting body is reduced. Thus, the reflector and the organic EL light-emitting body are preferably connected to each other so that the angle therebetween is greater than or equal to 90° and less than or equal to 150°.

Figure 1B:
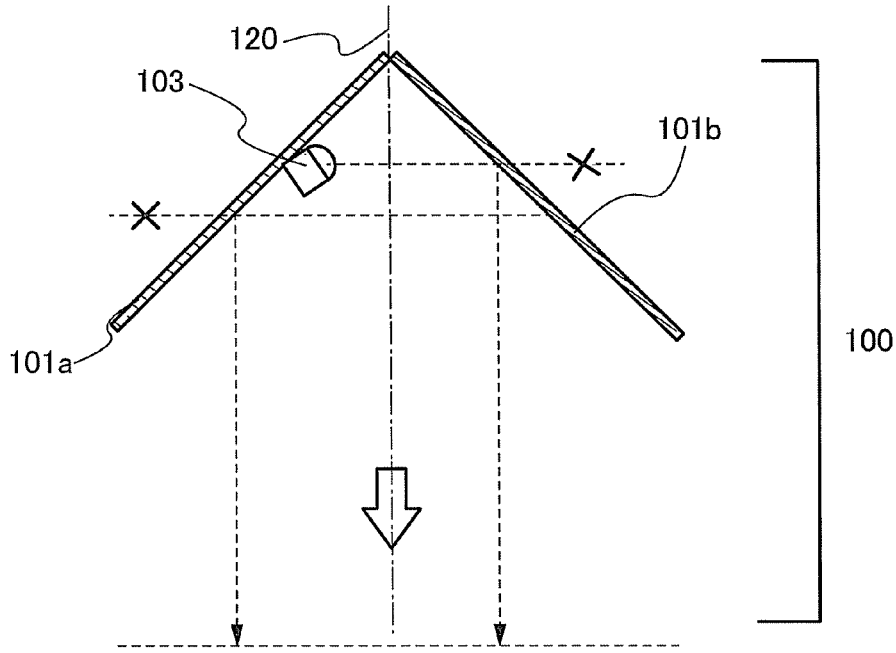

The reflector 101*a* described in this embodiment as an example is provided so as to form an angle of 90° with each of the organic EL light-emitting bodies 101*b* and 101*c* as illustrated in FIGS. 1A and 1B. Thus, the reflector 101*a* reflects light which leaks to the outside of the surface to be illuminated among light from the organic EL light-emitting bodies 101*b* and 101*c* toward the surface to be illuminated, and light emitted from the white lighting device can be efficiently converged.

The organic EL light-emitting bodies 101*b* and 101*c* are connected to each other to form an angle of 90°. Thus, the organic EL light-emitting bodies 101*b* and 101*c* reflect light emitted from the organic EL light-emitting body 101*c* and light emitted from the organic EL light-emitting body 101*b*, respectively, toward the surface to be illuminated, and light emitted from the white lighting device is efficiently converged.

That is, light which leaks to the outside of the surface to be illuminated from the organic EL light-emitting body 101*b* is converged by the reflector 101*a* and the organic EL light-emitting body 101*c* on the surface to be illuminated while light which leaks to the outside of the surface to be illuminated from the organic EL light-emitting body 101*c* is reflected by the reflector 101*a* and the organic EL light-emitting body 101*b* toward the surface to be illuminated.

The white lighting device 100 includes the LED provided in the inside of a conical body. Light from the LED 103 is reflected by the organic EL light-emitting body 101*b* and then enters the surface to be illuminated.

The LED can be provided on the surface of the organic EL light-emitting body or the reflector. It is preferable that the LED be provided on a non-light-emitting region of the organic EL light-emitting body because the light-emitting region of the organic EL light-emitting body is not covered by the LED.

Note that the non-light-emitting region of the organic EL light-emitting body is a region in the organic EL light-emitting body, in which a light-emitting layer is not provided and light is not emitted. For example, the non-light-emitting region is a region where a metal wiring is formed, such as a region 420 surrounded by a dotted line in FIG. 6.

A second axis, the direction to which the LED emits light, may be provided toward the organic EL light-emitting body, the reflector, or the surface to be illuminated. When the second axis is provided toward the organic EL light-emitting body or the reflector, light from the LED with high directivity does not directly enter eyes and the lighting having an advantage that glare due to light can be decreased can be obtained; thus, it is preferable to provide the second axis toward the organic EL light-emitting body or the reflector.

In this embodiment, the LED 103 emits light in a direction toward the organic EL light-emitting body 101*b* as illustrated in FIG. 1B.

Light emitted from the LED 103 is reflected by the organic EL light-emitting body 101*b* and then enters the surface to be illuminated.

Then, the method of manufacturing the white lighting device 100 described in this embodiment will be described.

First, the organic EL light-emitting body 101*b*, the organic EL light-emitting body 101*c*, and the reflector 101*a* are prepared (FIG. 7A) and connected to each other so as to form a conical body.

There is no particular limitation on the method for connecting the organic EL light-emitting body 101*b*, the organic EL light-emitting body 101*c*, and the reflector 101*a* to each other, and an adhesive, an organic resin, a hinge, a clasp, or the like may be used for the connection as appropriate.

Figure 7A:
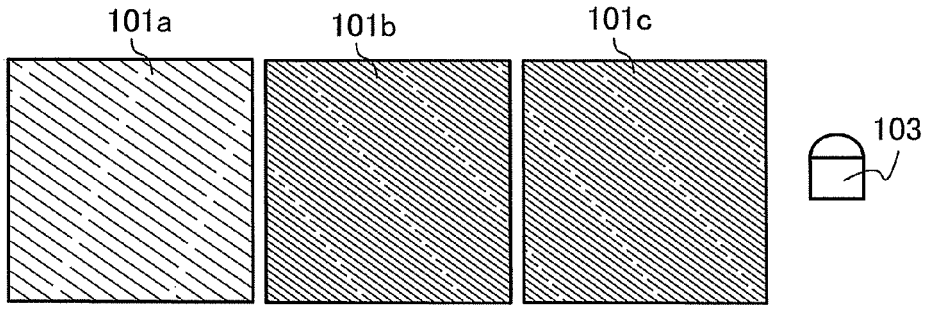
FIGS. 7A to 7C are diagrams explaining a method of manufacturing a lighting device according to one embodiment of the present invention.
Figure 7B:
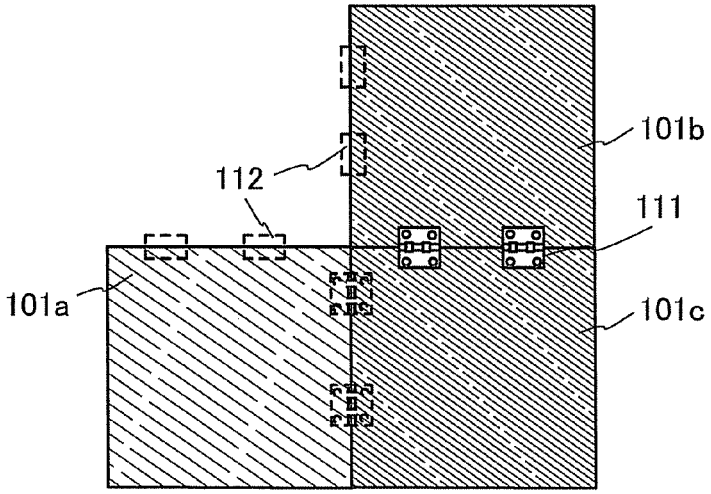

In this embodiment, a hinge 111 and a clasp 112 are used for the connection (FIG. 7B). A conical body which is formed using the organic EL light-emitting bodies 101*b* and 101*c* and the reflector 101*a* can be folded to be a plane with the use of a member which can move after the connection, such as a hinge or a clasp, which is convenient for transporting.

Then, the LED 103 is placed. The LED 103 can be directly bonded to the organic EL light-emitting body 101*b*, the organic EL light-emitting body 101*c*, or the reflector 101*a*. Alternatively, an LED support into which the LED 103 is fit can be provided. Note that in FIGS. 1A and 1B and FIGS. 4A to 4C, an LED support, a wiring included in the LED, and the like are not shown and but the arrangement of the LED in the conical body is shown.

Figure 7C:
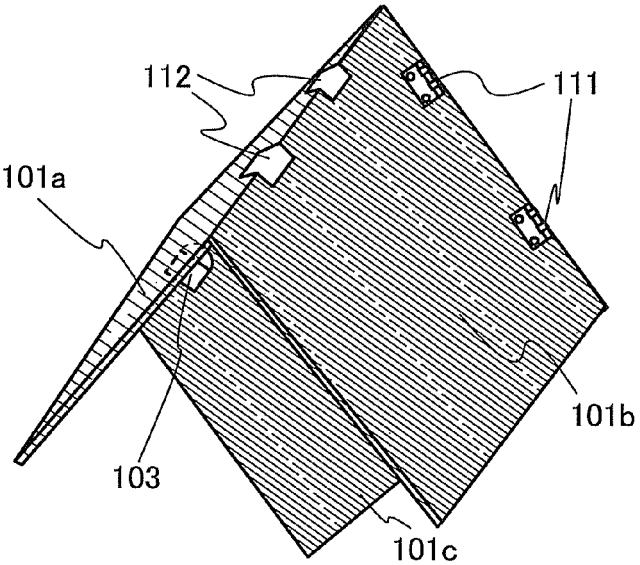

In this embodiment, the LED 103 is directly bonded to the reflector 101*a*. The organic EL light-emitting bodies 101*b* and 101*c* and the reflector 101*a* are assembled into a conical shape, and then the LED 103 is bonded to the reflector 101*a* (FIG. 7C). A commercialized adhesive, for example, an adhesive such as an epoxy resin-based adhesive or a resin additive may be used for bonding. The LED may be supported by an LED support as described in Embodiment 2.

In the above manner, the white lighting device 100 described in this embodiment can be manufactured.

Figure 4A:
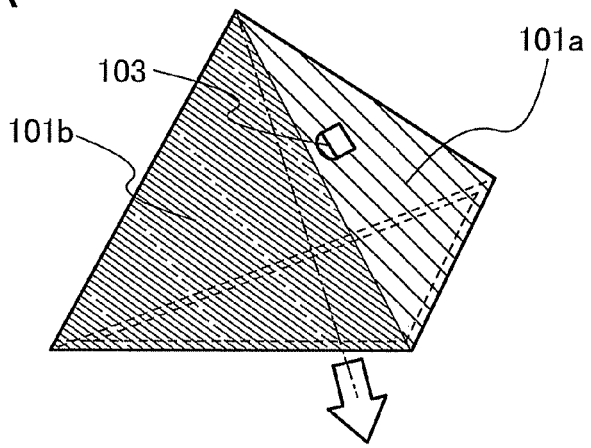
FIGS. 4A to 4C are perspective views of lighting devices according to embodiments of the present invention.
Figure 4B:
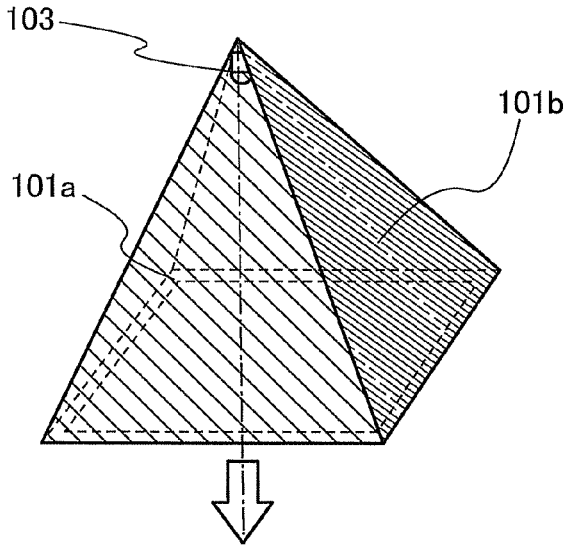

Although a white lighting device which forms part of a triangular pyramid with the use of an organic EL light-emitting body and a reflector is described in this embodiment, the shape of a white lighting device according to the present invention is not limited thereto, and the white lighting device may be a triangular pyramid as illustrated in FIG. 4A, a square pyramid as illustrated in FIG. 4B, a frustum of a pyramid, or the like.

Figure 4C:
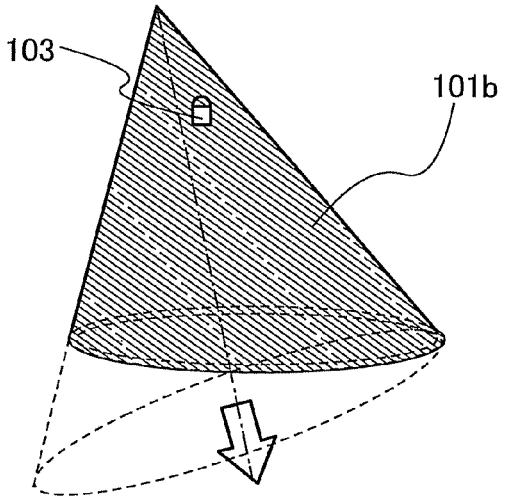

When an organic EL element is formed over a flexible substrate, a flexible organic EL light-emitting body can be formed. With the use of a flexible organic EL light-emitting body, a lighting device having a shape of a cone or the like with a curved surface as illustrated in FIG. 4C can be manufactured. Alternatively, a lighting device can have a variety of structures, for example, a frustum of a cone.

Note that a surface of a conical body does not need to be formed using one organic EL light-emitting body or one reflector. The surface of the conical body may be formed by connecting a plurality of organic EL light-emitting bodies or a plurality of reflectors to each other.

With the use of the white lighting device described in this embodiment, a white lighting device with high emission efficiency and directivity can be provided.

This embodiment can be freely combined with any of other embodiments.

Embodiment 2

In this embodiment, a structure of a white lighting device which is another embodiment of the present invention will be described with reference to FIG. 3. The white lighting device described in this embodiment has an organic EL support including an organic EL light-emitting body and an LED support including an LED. The organic EL support and the LED support are connected to each other.

Figure 3:
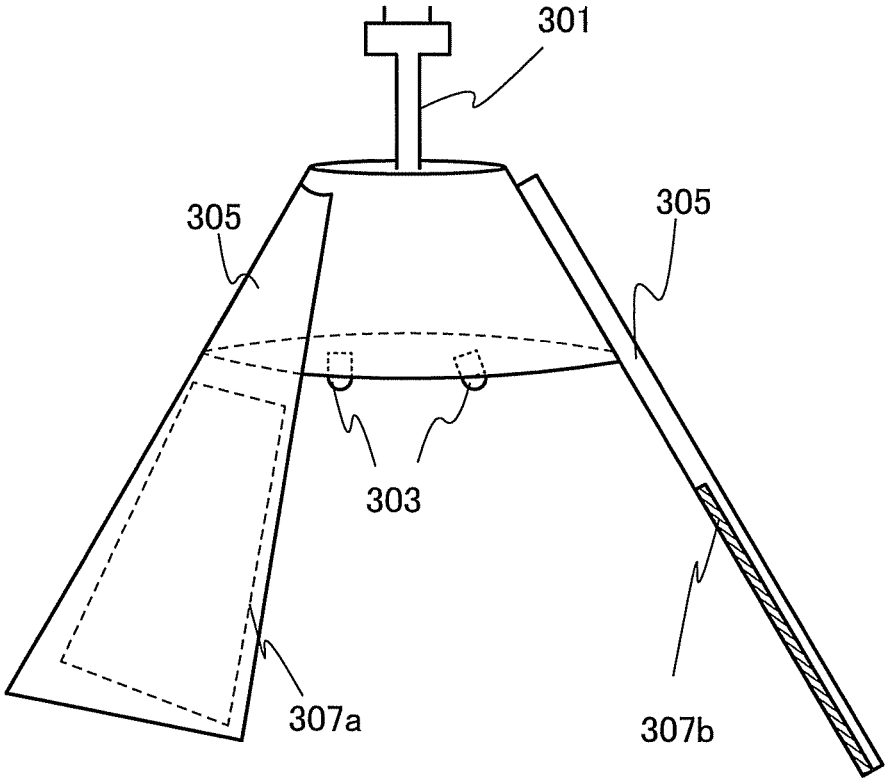
FIG. 3 is a cross-sectional view of a lighting device according to one embodiment of the present invention.

As illustrated in FIG. 3, the white lighting device described in this embodiment includes an LED support 301, an LED 303 provided on the LED support 301, an organic EL support 305, and organic EL light-emitting bodies 307*a* and 307*b* provided on the organic EL support 305. The organic EL support 305 is provided around the LED support 301.

Note that the organic EL light-emitting bodies 307*a* and 307*b* include reflective electrodes and serve as reflectors. Accordingly, the white lighting device described in this embodiment is a white lighting device according to one embodiment of the present invention in which part of a cone is formed using an organic EL light-emitting body and a reflector and an LED is provided in the inside of the cone.

The LED support 301 has a function of supporting the LED 303. As illustrated in FIG. 3, the LED support 301 has a shape of a frustum of a cone. Note that there is no particular limitation on the shape of an LED support applied to one embodiment of the present invention, and the shape of the LED support can be set as appropriate. The LED support includes an external power source connection terminal, a wiring, a socket into which an LED is fit, and the like, which are not illustrated in the drawing. The LED 303 is fit into a socket provided in the inside of the LED support 301, whereby the LED 303 can be electrically connected to an external power source.

For the LED support, glass, quartz, sapphire, silicon, plastics, elemental metal, alloy, or the like can be used, for example.

The LED support 301 can be provided so that the second axis is set in a desired direction where light from the LED 303 enters a surface to be illuminated. Specifically, light from the LED can be oriented toward the surface to be illuminated, or the second axis can be oriented toward the organic EL light-emitting body or the reflector so that light from the LED is reflected and then enters the surface to be illuminated.

Further, the surface of the LED support may have a function of reflecting light. The LED support having a function of reflecting light reflects light emitted from the organic EL light-emitting body toward the surface to be illuminated.

The LED 303 can be similar to the LED described in Embodiment 1.

The organic EL support 305 has a function of supporting the organic EL light-emitting body. The organic EL support 305 includes a depressed portion into which the organic EL light-emitting body is fit, an electrode provided in the inside of the depressed portion, a wiring connecting the electrode and an external power source to each other, and the like. The organic EL light-emitting bodies 307*a* and 307*b* are fit into the depressed portion, whereby the organic EL light-emitting body can be electrically connected to the external power source. Note that there is no particular limitation on the shape of an organic EL support applied to one embodiment of the present invention, and the shape of the organic EL support can be set as appropriate.

As the material of the organic EL support, glass, quartz, sapphire, silicon, plastics, elemental metal, alloy, or the like can be used, for example.

The organic EL support may be flexible as long as it can support the organic EL light-emitting body at a desired position in the conical body. The flexible organic EL support can be easily bonded to a curved surface or the like, so that the LED support can be designed more flexibly.

Further, the organic EL support may have a function of reflecting light from the LED or the organic EL light-emitting body toward the surface to be illuminated.

Each of the organic EL light-emitting bodies 307*a* and 307*b* can be similar to the organic EL light-emitting body described in Embodiment 1.

Note that each of the organic EL light-emitting bodies 307*a* and 307*b* includes a reflective electrode in this embodiment. The organic EL light-emitting bodies 307*a* and 307*b* face each other, whereby each of the organic EL light-emitting bodies 307*a* and 307*b* reflects light which leaks to the outside of the surface to be illuminated toward the surface to be illuminated.

As illustrated in FIG. 3, the organic EL support 305 is provided along the side of the LED support 301. The organic EL support may be provided to cover part of or the entire side of the LED support.

Each of the organic EL light-emitting bodies 307*a* and 307*b* includes the reflective electrode and serves as a reflector of the present invention. The organic EL light-emitting bodies 307*a* and 307*b* face each other so that the angle therebetween is greater than 0° and less than 180°. Thus, the organic EL light-emitting bodies 307*a* and 307*b* reflect light emitted from the organic EL light-emitting body 307*b* and light emitted from the organic EL light-emitting body 307*a*, respectively, and the light is efficiently converged.

Note that not all of the organic EL light-emitting bodies included in the white lighting device described in this embodiment are required to be in the same shape. For example, the organic EL light-emitting bodies 307*a* and 307*b* may have different shapes from each other. The organic EL light-emitting body can be provided only in an appropriate place in accordance with desired luminous flux.

The emission intensity of the organic EL light-emitting body and the LED may be set as appropriate, such that mixed light is white on a surface to be illuminated.

When the LED support and the organic EL support are provided, the organic EL light-emitting body and the LED can be easily detached. Thus, in the case where the lifetime of one of the organic EL light-emitting body and the LED in the white lighting device comes to an end, for example, the white lighting device is easily used again as a white lighting device by replacing only the part which needs to be replaced.

As described above, by applying one embodiment of the present invention, a white lighting device with high emission efficiency and directivity can be provided.

This embodiment can be freely combined with any of other embodiments.

Embodiment 3

In this embodiment, an example of an organic EL element which can be applied to one embodiment of the present invention will be described with reference to FIGS. 5A to 5C.

Figure 5A:
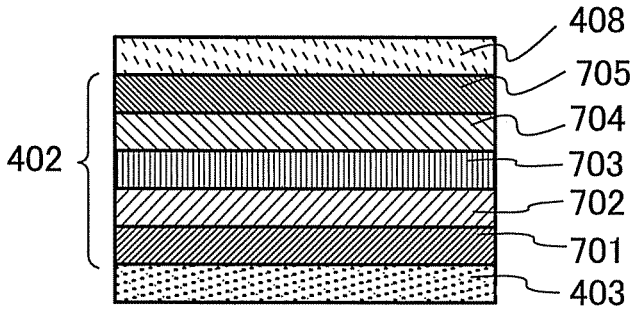
FIGS. 5A to 5C are schematic diagrams of organic EL elements used in embodiments of the present invention.

An organic EL element illustrated in FIG. 5A includes a first electrode 403, an EL layer 402 over the first electrode 403, and a second electrode 408 over the EL layer 402. An organic EL light-emitting body included in the white lighting device according to one embodiment of the present invention can be formed using one or more of organic EL elements illustrated in FIGS. 5A to 5C over a substrate.

Although the first electrode 403 functions as an anode and the second electrode 408 functions as a cathode in the organic EL element described in this embodiment, the present invention is not limited thereto. That is, the first electrode 403 may function as a cathode and the second electrode 408 may function as an anode.

The EL layer 402 includes at least a light-emitting layer containing a light-emitting organic compound. In addition, the EL layer 402 can have a stacked structure in which a layer containing a substance having a high electron-transport property, a layer containing a substance having a high hole-transport property, a layer containing a substance having a high electron-injection property, a layer containing a substance having a high hole-injection property, a layer containing a bipolar substance (a substance having a high electron-transport property and a high hole-transport property), and the like are combined as appropriate. In this embodiment, in the EL layer 402, a hole-injection layer 701, a hole-transport layer 702, a light-emitting layer 703, an electron-transport layer 704, and an electron-injection layer 705 are stacked in this order over the first electrode 403.

A method of manufacturing an organic EL element illustrated in FIG. 5A will be described.

First, the first electrode 403 is formed. For the first electrode 403 functioning as an anode, any of metals, alloys, electrically conductive compounds, mixtures thereof, and the like which has a high work function (specifically, a work function of 4.0 eV or more) is preferably used. Specific examples are given below: indium tin oxide (ITO), indium tin oxide containing silicon or silicon oxide, indium zinc oxide (IZO), and indium oxide containing tungsten oxide and zinc oxide. Besides, gold, platinum, nickel, tungsten, chromium, molybdenum, iron, cobalt, copper, palladium, titanium, or the like can be used.

When a layer included in the EL layer 402, which is formed in contact with the first electrode 403 is formed using a later described composite material in which an organic compound and an electron acceptor (acceptor) are mixed, the first electrode 403 can be formed using any of a variety of types of metals, alloys, electrically conductive compounds, a mixture thereof, and the like regardless of the work function. For example, aluminum, silver, an alloy containing aluminum (e.g., Al—Si), or the like can be used.

The first electrode 403 can be formed by, for example, a sputtering method, an evaporation method (including a vacuum evaporation method), or the like.

Next, the EL layer 402 is formed over the first electrode 403. In this embodiment, the EL layer 402 includes the hole-injection layer 701, the hole-transport layer 702, the light-emitting layer 703, the electron-transport layer. 704, and the electron-injection layer 705.

The hole-injection layer 701 is a layer that contains a substance having a high hole-injection property. Examples of the substance having a high hole-injection property which can be used are metal oxides, such as molybdenum oxide, titanium oxide, vanadium oxide, rhenium oxide, ruthenium oxide, chromium oxide, zirconium oxide, hafnium oxide, tantalum oxide, silver oxide, tungsten oxide, and manganese oxide. Other examples of the substance that can be used are phthalocyanine-based compounds, such as phthalocyanine (abbreviation: $H_2Pc$) and copper(II) phthalocyanine (abbreviation: CuPc).

Other examples of the substance that can be used are aromatic amine compounds which are low molecular organic compounds, such as 4,4',4"-tris(N,N-diphenylamino)triphenylamine (abbreviation: TDATA), 4,4',4"-tris[N-(3-methylphenyl)-N-phenylamino]triphenylamine (abbreviation: MTDATA), 4,4'-bis[N-(4-diphenylaminophenyl)-N-phenylamino]biphenyl (abbreviation: DPAB), N,N'-bis{4-[bis(3-methylphenyl)amino]phenyl}-N,N'-diphenyl-(1,1'-biphenyl)-4,4'-diamine (abbreviation: DNTPD), 1,3,5-tris[N-(4-diphenylaminophenyl)-N-phenylamino]benzene (abbreviation: DPA3B), 3-[N-(9-phenylcarbazol-3-yl)-N-phenylamino]-9-phenylcarbazole (abbreviation: PCzPCA1), 3,6-bis[N-(9-phenylcarbazol-3-yl)-N-phenylamino]-9-phenylcarbazole (abbreviation: PCzPCA2), and 3-[N-(1-naphthyl)-N-(9-phenylcarbazol-3-yl)amino]-9-phenylcarbazole (abbreviation: PCzPCN1).

Still other examples of the substance that can be used are high molecular compounds (e.g., oligomers, dendrimers, and polymers), such as poly(N-vinylcarbazole) (abbreviation: PVK), poly(4-vinyltriphenylamine) (abbreviation: PVTPA), poly[N-(4-{N'-[4-(4-diphenylamino)phenyl]phenyl-N'-phenylamino}phenyl)methacrylamide] (abbreviation: PTPDMA), and poly[N,N'-bis(4-butylphenyl)-N,N'-bis(phenyl)benzidine] (abbreviation: Poly-TPD). A high molecular compound to which acid is added, such as poly(3,4-ethylenedioxythiophene)/poly(styrenesulfonic acid) (PEDOT/PSS), or polyaniline/poly(styrenesulfonic acid) (PAni/PSS) can also be used.

In particular, for the hole-injection layer 701, a composite material in which an acceptor substance is added to an organic compound having a high hole-transport property is preferably used. Note that with the use of the composite material in which an acceptor substance is added to a substance having a high hole-transport property, hole injection from the first electrode 403 is facilitated, which leads to a reduction in the driving voltage of the organic EL element. Such a composite material can be formed by co-depositing a substance having a high hole-transport property and an acceptor substance. The hole-injection layer 701 is formed using the composite material, whereby hole injection from the first electrode 403 to the EL layer 402 is facilitated.

As the organic compound used for the composite material, a variety of compounds such as an aromatic amine compound, carbazole derivatives, aromatic hydrocarbon, and a high molecular compound (such as oligomer, dendrimer, or polymer) can be used. The organic compound used for the composite material is preferably an organic compound having a high hole-transport property. Specifically, a substance having a hole mobility of $10^{-6}$ $cm^2/Vs$ or higher is preferably used. Note that other than these substances, any substance that has a property of transporting more holes than electrons may be used. The organic compounds which can be used for the composite material will be specifically shown below.

Examples of the organic compound that can be used for the composite material include: aromatic amine compounds such as TDATA, MTDATA, DPAB, DNTPD, DPA3B, PCzPCA1, PCzPCA2, PCzPCN1, 4,4'-bis[N-(1-naphthyl)-N-phenylamino]biphenyl (abbreviation: NPB or α-NPD), N,N'-bis(3-methylphenyl)-N,N'-diphenyl-[1,1'-biphenyl]-4,4'-diamine (abbreviation: TPD), and 4-phenyl-4'-(9-phenylfluoren-9-yl) triphenylamine (abbreviation: BPAFLP); and carbazole derivatives such as 4,4'-di(N-carbazolyl)biphenyl (abbreviation: CBP), 1,3,5-tris[4-(N-carbazolyl)phenyl]benzene (abbreviation: TCPB), 9-[4-(N-carbazolyl)phenyl]-10-phenylanthracene (abbreviation: CzPA), 9-[4-(9-phenylcarbazol-3-yl)]phenyl-10-phenylanthracene (abbreviation: PCzPA), and 1,4-bis[4-(N-carbazolyl)phenyl]-2,3,5,6-tetraphenylbenzene.

Other examples of the organic compound that can be used are aromatic hydrocarbon compounds, such as 2-tert-butyl-9,10-di(2-naphthyl)anthracene (abbreviation: t-BuDNA), 2-tert-butyl-9,10-di(1-naphthyl)anthracene, 9,10-bis(3,5-diphenylphenyl)anthracene (abbreviation: DPPA), 2-tert-butyl-9,10-bis(4-phenylphenyl)anthracene (abbreviation: t-BuDBA), 9,10-di(2-naphthyl)anthracene (abbreviation: DNA), 9,10-diphenylanthracene (abbreviation: DPAnth), 2-tert-butylanthracene (abbreviation: t-BuAnth), 9,10-bis(4-methyl-1-naphthyl)anthracene (abbreviation: DMNA), 2-tert-butyl-9,10-bis[2-(1-naphthyl)phenyl]anthracene, 9,10-bis[2-(1-naphthyl)phenyl]anthracene, and 2,3,6,7-tetramethyl-9,10-di(1-naphthyl)anthracene.

Other examples of the organic compound that can be used are aromatic hydrocarbon compounds, such as 2,3,6,7-tetramethyl-9,10-di(2-naphthyl)anthracene, 9,9'-bianthryl, 10,10'-diphenyl-9,9'-bianthryl, 10,10'-bis(2-phenylphenyl)-9,9'-bianthryl, 10,10'-bis[(2,3,4,5,6-pentaphenyl)phenyl]-9,9'-bianthryl, anthracene, tetracene, rubrene, perylene, 2,5,8,11-tetra(tert-butyl)perylene, pentacene, coronene, 4,4'-bis(2,2-diphenylvinyl)biphenyl (abbreviation: DPVBi), and 9,10-bis[4-(2,2-diphenylvinyl)phenyl]anthracene (abbreviation: DPVPA).

Further, examples of the electron acceptor are organic compounds, such as 7,7,8,8-tetracyano-2,3,5,6-tetrafluoroquinodimethane (abbreviation: $F_4$-TCNQ) and chloranil, transition metal oxides, and oxides of metals that belong to Groups 4 to 8 in the periodic table. Specific preferred examples include vanadium oxide, niobium oxide, tantalum oxide, chromium oxide, molybdenum oxide, tungsten oxide, manganese oxide, and rhenium oxide because their electron-acceptor properties are high. Among these, molybdenum oxide is especially preferable since it is stable in the air and its hygroscopic property is low and is easily treated.

The composite material may be formed using the above-described electron acceptor and the above-described high molecular compound such as PVK, PVTPA, PTPDMA, or Poly-TPD, and used for the hole-injection layer 701.

The hole-transport layer 702 is a layer that contains a substance having a high hole-transport property. As the substance having a high hole-transport property, any of the following aromatic amine compounds can be used, for example: NPB; TPD; BPAFLP; 4,4'-bis[N-(9,9-dimethylfluoren-2-yl)-N-phenylamino]biphenyl (abbreviation: DFLDPBi); and 4,4'-bis[N-(spiro-9,9'-bifluoren-2-yl)-N-phenylamino]biphenyl (abbreviation: BSPB). The substances mentioned here mainly have a hole mobility of $10^{-6}$ $cm^2/Vs$ or higher. Note that other than the above substances, any substance that has a property of transporting more holes than electrons may be used. Further, the layer that contains a substance having a high hole-transport property is not limited to a single layer, and two or more layers that contain the above-described substances may be stacked.

For the hole-transport layer 702, a carbazole derivative, such as CBP, CzPA, or PCzPA, or an anthracene derivative, such as t-BuDNA, DNA, or DPAnth, may be used.

For the hole-transport layer 702, a high molecular compound such as PVK, PVTPA, PTPDMA, or Poly-TPD, can be used.

The light-emitting layer 703 is a layer that contains a light-emitting organic compound. Examples of the light-emitting organic compound include a fluorescent compound which exhibits fluorescence and a phosphorescent compound which exhibits phosphorescence.

In one embodiment of the present invention, when the emission color of the organic EL element is a complementary color of the emission color of a blue LED, a lighting device which emits white light as a whole lighting device is obtained. Note that the word "complementary" means color relationship in which an achromatic color is obtained when colors are mixed. That is, when light of complementary colors emitted from substances are mixed, white light emission can be obtained.

The light-emitting layer 703 can emit light having a complementary color of the emission color of a blue LED by selecting a light-emitting material that emits any color of red to green light as appropriate.

In one embodiment of the present invention, the organic EL element may include two or more light-emitting layers. By providing a plurality of light-emitting layers and making emission colors of the light-emitting layers different, light emission of a desired color can be obtained from the organic EL element as a whole.

The fluorescent compounds that can be used for the light-emitting layer 703 are given below. Examples of the material that emits green light include 9,10-diphenyl-2-[N-phenyl-N-(9-phenyl-9H-carbazol-3-yl)amino]anthracene (abbreviation: 2PCAPA), 9,10-(biphenyl-2-yl)-2-[N-phenyl-N-(9-phenyl-9H-carbazol-3-yl)amino]anthracene (abbreviation: 2PCABPhA), 9,10-diphenyl-2-[N-(4-diphenylaminophenyl)-N-phenylamino]anthracene (abbreviation: 2DPAPA), 9,10-di(2-biphenylyl)-2-[N-(4-diphenylaminophenyl)-N-phenylamino]anthracene (abbreviation: 2DPABPhA), 9,10-di(2-biphenylyl)-2-{N-[4-(9H-carbazol-9-yl)phenyl]-N-phenylamino}anthracene (abbreviation: 2YGABPhA), 9-(N,N-diphenylamnino)-10-phenylanthracene (abbreviation: DPhAPhA), and the like. Examples of the material that emits yellow light include rubrene, 5,12-bis(1,1'-biphenyl-4-yl)-6,11-diphenyltetracene (abbreviation: BPT), and the like. Examples of the material that emits red light include N,N,N'N'-tetrakis(4-methylphenyl)tetracene-5,11-diamine (abbreviation: p-mPhTD), 7,14-diphenyl-N,N,N',N'-tetrakis(4-methylphenyl)pacenaphtho[1,2-a]fluoranthene-3,10-diamine (abbreviation: p-mPhAFD), and the like.

The phosphorescent compounds that can be used for the light-emitting layer 703 are given below. Examples of the material that emits green light include tris(2-phenylpyridinato-N,$C^{2'}$)iridium(III) (abbreviation: $Ir(ppy)_3$), bis(2-phenylpyridinato-N,$C^{2'}$)iridium(III)acetylacetonate (abbreviation: $Ir(ppy)_2(acac)$), bis(1,2-diphenyl-1H-benzimidazolato) iridium(III)acetylacetonate (abbreviation: $Ir(pbi)_2(acac)$), bis (benzo[h]quinolinato)iridium(III)acetylacetonate (abbreviation: $Ir(bzq)_2(acac)$), tris(benzo[h]quinolinato)iridium(III) (abbreviation: $Ir(bzq)_3$), and the like. Examples of the material that emits yellow light include bis(2,4-diphenyl-1,3-oxazolato-N,$C^{2'}$)iridium(III)acetylacetonate (abbreviation: $Ir(dpo)_2(acac)$), bis[2-(4'-perfluorophenylphenyl)pyridinato]iridium(III)acetylacetonate (abbreviation: Ir(p-PF-ph)$_2$(acac)), bis(2-phenylbenzothiazolato-N,C$^{2'}$)iridium(III) acetylacetonate (abbreviation: Ir(bt)$_2$(acac)), (acetylacetonato)bis[2,3-bis(4-fluorophenyl)-5-methylpyrazinato]iridium(III) (abbreviation: Ir(Fdppr-Me)$_2$(acac)), (acetylacetonato)bis[2-(4-methoxyphenyl)-3,5-dimethylpyrazinato]iridium(III) (abbreviation: Ir(dmmoppr)$_2$(acac)), and the like. Examples of the material that emits orange light include tris(2-phenylquinolinato-N,C$^{2'}$)iridium(III) (abbreviation: Ir(pq)$_3$), bis(2-phenylquinolinato-N,C$^{2'}$)iridium(III)acetylacetonate (abbreviation: Ir(pq)$_2$(acac)), (acetylacetonato)bis(3,5-dimethyl-2-phenylpyrazinato)iridium(III) (abbreviation: Ir(mppr-Me)$_2$(acac)), (acetylacetonato)bis(5-isopropyl-3-methyl-2-phenylpyrazinato)iridium(III) (abbreviation: Ir(mppr-iPr)$_2$(acac)), and the like. Examples of the material that emits red light include organometallic complexes such as bis[2-(2'-benzo[4,5-α]thienyl)pyridinato-N,C$^{3'}$)iridium(III)acetylacetonate (abbreviation: Ir(btp)$_2$(acac)), bis(1-phenylisoquinolinato-N,C$^{2'}$)iridium(III)acetylacetonate (abbreviation: Ir(piq)$_2$(acac), bis[2,3-bis(4-fluorophenyl)quinoxalinato]iridium(III) acetylacetonate (abbreviation: Ir(Fdpq)$_2$(acac)), (acetylacetonato)bis(2,3,5-triphenylpyrazinato)iridium(III) (abbreviation: Ir(tppr)$_2$(acac)), (acetylacetonato)bis(2,3,5-triphenylpyrazinato)iridium(III) (abbreviation: Ir(tppr)$_2$(dpm)), and (2,3,7,8,12,13,17,18-octaethyl-21H,23H-porphyrinato)platinum(II) (abbreviation: PtOEP). Any of the following rare earth metal complexes can be used as the phosphorescent compound: tris(acetylacetonato)(monophenanthroline)terbium(III) (abbreviation: Tb(acac)$_3$(Phen)); tris(1,3-diphenyl-1,3-propanedionato)(monophenanthroline)europium(III) (abbreviation: Eu(DBM)$_3$(Phen)); tris[1-(2-thenoyl)-3,3,3-trifluoroacetonato](monophenanthroline)europium(III) (abbreviation: Eu(TTA)$_3$(Phen)); and the like, because their light emission is from a rare earth metal ion (electronic transition between different multiplicities).

Note that the light-emitting layer 703 may have a structure in which the above-described light-emitting organic compound (a guest material) is dispersed in another substance (a host material). As a host material, a variety of kinds of materials can be used, and it is preferable to use a substance which has a lowest unoccupied molecular orbital level (LUMO level) higher than the light-emitting substance and has a highest occupied molecular orbital level (HOMO level) lower than the light-emitting substance.

Specific examples of the host material are as follows: a metal complex such as tris(8-quinolinolato)aluminum(III) (abbreviation: Alq), tris(4-methyl-8-quinolinolato)aluminum(III) (abbreviation: Almq$_3$), bis(10-hydroxybenzo[h]quinolinato)beryllium(II) (abbreviation: BeBq$_2$), bis(2-methyl-8-quinolinolato)(4-phenylphenolato)aluminum(III) (abbreviation: BAlq), bis(8-quinolinolato)zinc(II) (abbreviation: Znq), bis[2-(2-benzoxazolyl)phenolato]zinc(II) (abbreviation: ZnPBO, or bis[2-(2-benzothiazolyl)phenolato]zinc(II) (abbreviation: ZnBTZ); a heterocyclic compound such as 2-(4-biphenylyl)-5-(4-tert-butylphenyl)-1,3,4-oxadiazole (abbreviation: PBD), 1,3-bis[5-(p-tert-butylphenyl)-1,3,4-oxadiazol-2-yl]benzene (abbreviation: OXD-7), 3-(4-biphenylyl)-4-phenyl-5-(4-tert-butylphenyl)-1,2,4-triazole (abbreviation: TAZ), 2,2',2"-(1,3,5-benzenetriyl)-tris(1-phenyl-1H-benzimidazole) (abbreviation: TPBI), bathophenanthroline (abbreviation: BPhen), or bathocuproine (BCP); a condensed aromatic compound such as 9-[4-(N-carbazolyl)phenyl]-10-phenylanthracene (abbreviation: CzPA), 9-[4-(3,6-diphenyl-N-carbazolyl)phenyl]-10-phenylanthracene (abbreviation: DPCzPA), 9,10-bis(3,5-diphenylphenyl)anthracene (abbreviation: DPPA), 9,10-di(2-naphthyl)anthracene (abbreviation: DNA), 2-tert-butyl-9,10-di(2-naphthyl)anthracene (abbreviation: t-BuDNA), 9,9'-bianthryl (abbreviation: BANT), 9,9'-(stilbene-3,3'-diyl)diphenanthrene (abbreviation: DPNS), 9,9'-(stilbene-4,4'-diyl)diphenanthrene (abbreviation: DPNS2), 1,3,5-tri(1-pyrenyl)benzene (abbreviation: TPB3), 9,10-diphenylanthracene (abbreviation: DPAnth), or 6,12-dimethoxy-5,11-diphenylchrysene; an aromatic amine compound such as 9-{-4-[3-(N,N-diphenylamino)-N-carbazolyl]}phenyl-10-phenylanthracene (abbreviation: CzA1PA), 4-(10-phenyl-9-anthryl)triphenylamine (abbreviation: DPhPA), 9-phenyl-10-(4-[N-phenyl-N-{3-(N-phenyl)carbazolyl}]amino)phenylanthracene (abbreviation: PCAPA), 9-[4'-{N-phenyl-N-(9-phenylcarbazol-3-yl)}aminobiphenyl-4-yl]-10-phenylanthracene (abbreviation: PCAPBA), 9,10-diphenyl-2-[N-phenyl-N-(9-phenyl-9H-carbazol-3-yl)amino]anthracene (abbreviation: 2PCAPA), NPB (or α-NPD), TPD, DFLDPBi, or BSPB; and the like.

Alternatively, as the host material, plural kinds of materials can be used. For example, in order to suppress crystallization, a substance such as rubrene which suppresses crystallization, may be further added. In addition, NPB, Alq, or the like may be further added in order to efficiently transfer energy to the guest material.

When a structure in which a guest material is dispersed in a host material is employed, crystallization of the light-emitting layer 703 can be suppressed. Further, concentration quenching due to high concentration of the guest material can be suppressed.

For the light-emitting layer 703, a high molecular compound can be used. Specifically, examples of the material that emits green light include poly(p-phenylenevinylene) (abbreviation: PPV), poly[(9,9-dihexylfluorene-2,7-diyl)-alt-co-(benzo[2,1,3]thiadiazole-4,7-diyl)] (abbreviation: PFBT), poly[(9,9-dioctyl-2,7-divinylenefluorenylene)-alt-co-(2-methoxy-5-(2-ethylhexyloxy)-1,4-phenylene)], and the like. Examples of the material that emits any color of orange to red light include poly[2-methoxy-5-(2-ethylhexoxy)-1,4-phenylenevinylene] (abbreviation: MEH-PPV), poly(3-butylthiophene-2,5-diyl), poly{[9,9-dihexyl-2,7-bis(1-cyanovinylene)fluorenylene]-alt-co-[2,5-bis(N,N'-diphenyl amino)-1,4-phenylene]}, poly{[2-methoxy-5-(2-ethylhexyloxy)-1,4-bis(1-cyanovinylenephenylene)]-alt-co-[2,5-bis(N,N'-diphenylamino)-1,4-phenylene]} (abbreviation: CN-PPV-DPD), and the like.

The electron-transport layer 704 is a layer that contains a substance having a high electron-transport property. An example of a substance having a high electron-transport property which can be used is a metal complex or the like having a quinoline skeleton or a benzoquinoline skeleton, such as tris(8-quinolinolato)aluminum(III) (abbreviation: Alq), tris(4-methyl-8-quinolinolato)aluminum(III) (abbreviation: Almq$_3$), bis(10-hydroxybenzo[h]quinolinato)beryllium(II) (abbreviation: BeBq$_2$), or bis(2-methyl-8-quinolinolato)(4-phenylphenolato)aluminum(III) (abbreviation: BAlq). Alternatively, a metal complex or the like including an oxazole-based or thiazole-based ligand, such as bis[2-(2-benzoxazolyl)phenolato]zinc(II) (abbreviation: Zn(BOX)$_2$) or bis[2-(2-hydroxyphenyl)benzothiazolato]zinc (abbreviation: Zn(BTZ)$_2$) can be used. Besides the metal complexes, 2-(4-biphenylyl)-5-(4-tert-butylphenyl)-1,3,4-oxadiazole (abbreviation: PBD), 1,3-bis[5-(p-tert-butylphenyl)-1,3,4-oxadiazol-2-yl]benzene (abbreviation: OXD-7), 3-(4-biphenylyl)-4-phenyl-5-(4-tert-butylphenyl)-1,2,4-triazole (abbreviation: TAZ), bathophenanthroline (abbreviation: BPhen), bathocuproine (abbreviation: BCP), or the like can also be used. The substances mentioned here mainly have an electron mobility of $10^{-6}$ $cm^2/Vs$ or higher. Furthermore, the electron-transport layer is not limited to a single layer, and two or more layers that contain the above-described substances may be stacked.

The electron-injection layer 705 is a layer that contains a substance having a high electron-injection property. For the electron-injection layer 705, an alkali metal, an alkaline earth metal, or a compound thereof, such as lithium, cesium, calcium, lithium fluoride, cesium fluoride, calcium fluoride, or lithium oxide, can be used. In addition, a rare earth metal compound such as erbium fluoride can also be used. Any of the substances contained in the electron-transport layer 704 which are given above can also be used.

Note that the hole-injection layer 701, the hole-transport layer 702, the light-emitting layer 703, the electron-transport layer 704, and the electron-injection layer 705, which are described above can each be formed by a method such as an evaporation method (e.g., a vacuum evaporation method), an ink-jet method, or a coating method.

Figure 5B:
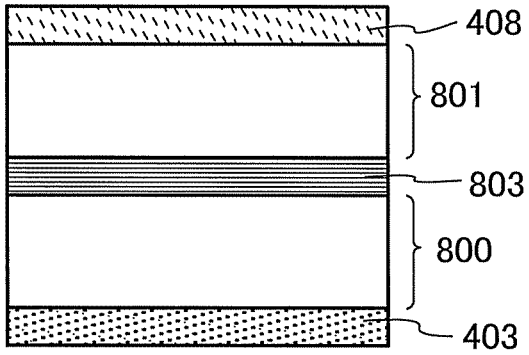

Note that a plurality of EL layers 402 may be stacked between the first electrode 403 and the second electrode 408 as illustrated in FIG. 5B. In that case, a charge generation layer 803 is preferably provided between a first EL layer 800 and a second EL layer 801 which are stacked. Note that the first EL layer 800 and the second EL layer 801 each correspond to the EL layer 402. The charge generation layer 803 can be formed by using the above-mentioned composite material. Further, the charge generation layer 803 may have a stacked structure of a layer containing the composite material and a layer containing another material. In that case, as the layer that contains another material, a layer that contains an electron-donating substance and a substance having a high electron-transport property, a layer formed of a transparent conductive film, or the like can be used. As for an organic EL element having such a structure, problems such as energy transfer and quenching hardly occur, and an organic EL element which has both high emission efficiency and a long lifetime can be easily obtained due to expansion in the choice of materials. Moreover, an organic EL element which provides phosphorescence from one of the EL layers and fluorescence from another EL layer can be readily obtained. Note that this structure can be combined with the above-described structures of the EL layer.

Figure 5C:
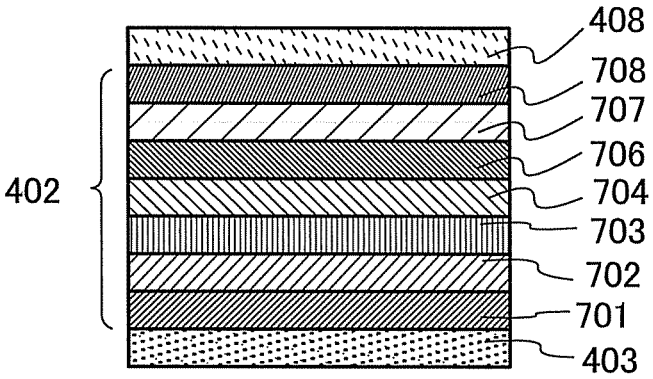

As illustrated in FIG. 5C, the EL layer 402 may include the hole-injection layer 701, the hole-transport layer 702, the light-emitting layer 703, the electron-transport layer 704, an electron-injection buffer layer 706, an electron-relay layer 707, and a composite material layer 708 which is in contact with the second electrode 408, between the first electrode 403 and the second electrode 408.

It is preferable to provide the composite material layer 708 which is in contact with the second electrode 408, in which case damage caused to the EL layer 402 particularly when the second electrode 408 is formed by a sputtering method can be reduced. The composite material layer 708 can be formed using the above-described composite material in which an acceptor substance is added to an organic compound having a high hole-transport property.

Further, by providing the electron-injection buffer layer 706, an injection barrier between the composite material layer 708 and the electron-transport layer 704 can be reduced; thus, electrons generated in the composite material layer 708 can be easily injected to the electron-transport layer 704.

A substance having a high electron-injection property can be used for the electron-injection buffer layer 706: for example, an alkali metal, an alkaline earth metal, a rare earth metal, or a compound of the above metal (e.g., an alkali metal compound (e.g., an oxide such as lithium oxide, a halide, or a carbonate such as lithium carbonate or cesium carbonate), an alkaline earth metal compound (e.g., an oxide, a halide, or a carbonate), or a rare earth metal compound (e.g., an oxide, a halide, or a carbonate)).

Further, in the case where the electron-injection buffer layer 706 contains a substance having a high electron-transport property and a donor substance, the donor substance is preferably added so that the mass ratio of the donor substance to the substance having a high electron-transport property is from 0.001:1 to 0.1:1. Note that as the donor substance, an organic compound such as tetrathianaphthacene (abbreviation: TTN), nickelocene, or decamethylnickelocene can be used as well as an alkali metal, an alkaline earth metal, a rare earth metal, or a compound of the above metal (e.g., an alkali metal compound (e.g., an oxide such as lithium oxide, a halide, or a carbonate such as lithium carbonate or cesium carbonate), an alkaline earth metal compound (e.g., an oxide, a halide, or a carbonate), or a rare earth metal compound (e.g., an oxide, a halide, or a carbonate)). Note that as the substance having a high electron-transport property, a material similar to the material for the electron-transport layer 704 described above can be used.

Furthermore, the electron-relay layer 707 is preferably formed between the electron-injection buffer layer 706 and the composite material layer 708. The electron-relay layer 707 is not necessarily provided; however, by providing the electron-relay layer 707 having a high electron-transport property, electrons can be rapidly transported to the electron-injection buffer layer 706.

The structure in which the electron-relay layer 707 is sandwiched between the composite material layer 708 and the electron-injection buffer layer 706 is a structure in which the acceptor substance contained in the composite material layer 708 and the donor substance contained in the electron-injection buffer layer 706 are less likely to interact with each other, and thus their functions hardly interfere with each other. Accordingly, an increase in the driving voltage can be prevented.

The electron-relay layer 707 contains a substance having a high electron-transport property and is formed so that the LUMO level of the substance having a high electron-transport property is located between the LUMO level of the acceptor substance contained in the composite material layer 708 and the LUMO level of the substance having a high electron-transport property contained in the electron-transport layer 704. In the case where the electron-relay layer 707 contains a donor substance, the donor level of the donor substance is controlled so as to be located between the LUMO level of the acceptor substance in the composite material layer 708 and the LUMO level of the substance having a high electron-transport property contained in the electron-transport layer 704. As a specific value of the energy level, the LUMO level of the substance having a high electron-transport property contained in the electron-relay layer 707 is preferably greater than or equal to −5.0 eV, more preferably greater than or equal to −5.0 eV and less than or equal to −3.0 eV.

As the substance having a high electron-transport property contained in the electron-relay layer 707, a phthalocyanine-based material or a metal complex having a metal-oxygen bond and an aromatic ligand is preferably used.

As the phthalocyanine-based material contained in the electron-relay layer 707, in particular, any of the followings is preferably used: CuPc, phthalocyanine tin(II) complex (SnPc), phthalocyanine zinc complex (ZnPc), cobalt(II)

phthalocyanine, β-form (CoPc), phthalocyanine iron (FePc), and vanadyl 2,9,16,23-tetraphenoxy-29H,31H-phthalocyanine (PhO-VOPc).

As the metal complex having a metal-oxygen bond and an aromatic ligand, which is contained in the electron-relay layer 707, a metal complex having a metal-oxygen double bond is preferably used. The metal-oxygen double bond has acceptor properties (properties of easily accepting electrons); thus, electrons can be transferred (donated and accepted) more easily. Further, the metal complex having a metal-oxygen double bond is considered stable. Thus, the use of the metal complex having the metal-oxygen double bond enables the organic EL element to drive at low voltage more stably.

As the metal complex having a metal-oxygen bond and an aromatic ligand, a phthalocyanine-based material is preferable. Specifically, any of vanadyl phthalocyanine (VOPc), a phthalocyanine tin (IV) oxide complex (SnOPc), and a phthalocyanine titanium oxide complex (TiOPc) is preferable because a metal-oxygen double bond is more likely to act on another molecular in terms of a molecular structure and an acceptor property is high.

Note that as the phthalocyanine-based materials described above, a phthalocyanine-based material having a phenoxy group is preferable. Specifically, a phthalocyanine derivative having a phenoxy group, such as PhO-VOPc, is preferable. The phthalocyanine derivative having a phenoxy group is soluble in a solvent; thus, the phthalocyanine derivative has an advantage of being easily handled during formation of an organic EL element and an advantage of facilitating maintenance of an apparatus used for deposition.

The electron-relay layer 707 may further contain a donor substance. As the donor substance, an organic compound such as tetrathianaphthacene (abbreviation: TTN), nickelocene, or decamethylnickelocene can be used as well as an alkali metal, an alkaline earth metal, a rare earth metal, or a compound of the above metal (e.g., an alkali metal compound (e.g., an oxide such as lithium oxide, a halide, or a carbonate such as lithium carbonate or cesium carbonate), an alkaline earth metal compound (e.g., an oxide, a halide, or a carbonate), or a rare earth metal compound (e.g., an oxide, a halide, or a carbonate)). When such a donor substance is contained in the electron-relay layer 707, electrons can be transferred easily and the organic EL element can be driven at lower voltage.

In the case where a donor substance is contained in the electron-relay layer 707, in addition to the materials described above as the substance having a high electron-transport property, a substance having a LUMO level greater than the acceptor level of the acceptor substance contained in the composite material layer 708 can be used. As a specific energy level, a LUMO level is preferably greater than or equal to −5.0 eV, more preferably greater than or equal to −5.0 eV and less than or equal to −3.0 eV. As examples of such a substance, a perylene derivative and a nitrogen-containing condensed aromatic compound can be given. Note that the nitrogen-containing condensed aromatic compound is preferably used for the electron-relay layer 707 because of its stability.

As specific examples of the perylene derivative, the following can be given: 3,4,9,10-perylenetetracarboxylicdianhydride (abbreviation: PTCDA), bisbenzimidazo[2,1-a:2',1'-a]anthra[2,1,9-def:6,5,10-d'e'f']diisoquinoline-10,21-dione (abbreviation: PTCBI), N,N'-dioctyl-3,4,9,10-perylenetetracarboxylic diimide (abbreviation: PTCDI-C8H), N,N'-dihexyl-3,4,9,10-perylenetetracarboxylic diimide (Hex PTC), and the like.

As specific examples of the nitrogen-containing condensed aromatic compound, the following can be given: pirazino[2,3-f][1,10]phenanthroline-2,3-dicarbonitrile (PPDN), 2,3,6,7,10,11-hexacyano-1,4,5,8,9,12-hexaazatriphenylene (HAT(CN)$_6$), 2,3-diphenylpyrido[2,3-b]pyrazine (2PYPR), 2,3-bis(4-fluorophenyl)pyrido[2,3-b]pyrazine (F2PYPR), and the like.

Besides, 7,7,8,8-tetracyanoquinodimethane (abbreviation: TCNQ), 1,4,5,8-naphthalenetetracarboxylicdianhydride (abbreviation: NTCDA), perfluoropentacene, copper hexadecafluorophthalocyanine (abbreviation: $F_{16}$CuPc), N,N'-bis(2,2,3,3,4,4,5,5,6,6,7,7,8,8,8-pentadecafluorooctyl)-1,4,5,8-naphthalenetetracar boxylic diimide (abbreviation: NTCDI-C8F), 3',4'-dibutyl-5,5"-bis(dicyanomethylene)-5,5"-dihydro-2,2':5',2"-terthiophene (abbreviation: DCMT), a methanofullerene (e.g., [6,6]-phenyl $C_{61}$ butyric acid methyl ester), or the like can be used.

Note that in the case where a donor substance is contained in the electron-relay layer 707, the electron-relay layer 707 may be formed by a method such as co-evaporation of the substance having a high electron-transport property and the donor substance.

The hole-injection layer 701, the hole-transport layer 702, the light-emitting layer 703, and the electron-transport layer 704 may be each formed using any of the above-described materials.

Then, the second electrode 408 is formed over the EL layer 402.

For the second electrode 408 functioning as a cathode, any of metals, alloys, electrically conductive compounds, mixtures thereof, and the like which has a low work function (specifically, a work function of 3.8 eV or less) is preferably used. Specific examples of the substance that can be used are elements that belong to Groups 1 and 2 in the periodic table, that is, alkali metals such as lithium and cesium, alkaline earth metals such as magnesium, calcium, and strontium, alloys thereof (e.g., Mg—Ag and Al—Li), rare earth metals such as europium and ytterbium, alloys thereof, aluminum, silver, and the like.

When a layer included in the EL layer 402, which is formed in contact with the second electrode 408 is formed using the above-described composite material in which the organic compound and the electron donor (donor) are mixed, a variety of conductive materials such as Al, Ag, ITO, and indium tin oxide containing silicon or silicon oxide can be used regardless of the work function.

Note that the second electrode 408 can be formed by a vacuum evaporation method or a sputtering method. Alternatively, in the case of using a silver paste or the like, a coating method, an inkjet method, or the like can be used.

With the use of the organic EL element described in this embodiment in the organic EL light-emitting body provided in the white lighting device described in Embodiment 1 or Embodiment 2, a white lighting device with high emission efficiency and directivity can be manufactured.

This embodiment can be combined with any of other embodiments.

Embodiment 4

Figure 6:
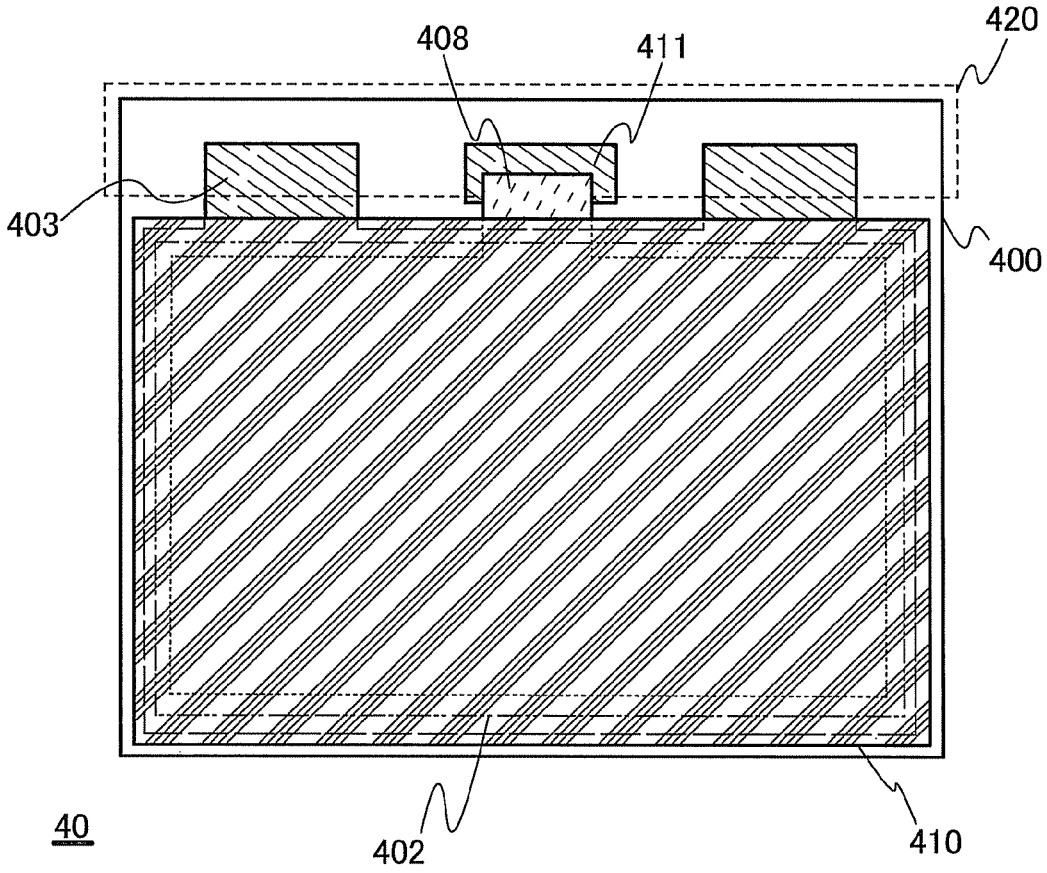
FIG. 6 is a schematic diagram of organic EL an light-emitting body used in one embodiment of the present invention.

In this embodiment, a method of manufacturing an organic EL light-emitting body according to one embodiment of the present invention will be described with reference to FIG. 6. FIG. 6 is a schematic diagram showing an organic EL light-emitting body in this embodiment.

An organic EL light-emitting body 40 in FIG. 6 includes an organic EL element (the first electrode 403, the EL layer 402 including a light-emitting layer, and the second electrode 408) over a substrate 400. Further, the organic EL light-emitting body 40 includes a conductive layer 411 formed using a material similar to that of the first electrode 403. The conductive layer 411 functions as a connection terminal. Furthermore, the organic EL light-emitting body 40 includes a sealing substrate 410 over the second electrode 408.

For the substrate 400, glass, quartz, plastics, or the like can be used, for example.

Note that in the case where the organic EL element has a bottom emission structure, it is preferable that a support substrate of the organic EL element have an uneven structure on a side through which light is extracted. When the organic EL element has an uneven structure on the side through which light is extracted, total reflection hardly occurs at an interface between the support substrate and the air, whereby substrate-mode light, which has been conventionally guided in the support substrate, can be extracted outside. Thus, the light extraction efficiency can be increased.

First, the organic EL element is formed over the substrate 400. The organic EL element may be formed using the structure and the method described in Embodiment 3, for example. In this embodiment, the conductive layer 411 is formed at the same time as the first electrode 403.

Note that in this embodiment, the organic EL element may have either a top emission structure or a bottom emission structure.

An electrode provided on the side opposite to the side from which light is extracted functions as a reflective electrode. For example, in the case of a top emission structure, light is extracted from the side opposite to the substrate, so that the first electrode which is provided between the substrate and the EL layer functions as a reflective electrode. Alternatively, in the case of a bottom emission structure, the second electrode opposite to the substrate functions as a reflective electrode. The reflective electrode is fainted using a material which reflects visible light. The visible light reflectance of the reflective electrode is preferably 60% or more, more preferably 80% or more, much more preferably 90% or more.

As the material that can be used for the reflective electrode, a metal material such as aluminum, gold, platinum, silver, nickel, tungsten, chromium, molybdenum, iron, cobalt, copper, or palladium can be given. Besides, an alloy containing aluminum (an aluminum alloy) such as an alloy of aluminum and titanium, an alloy of aluminum and nickel, or an alloy of aluminum and neodymium, or an alloy containing silver such as an alloy of silver and copper can be used. An alloy of silver and copper is preferable because of its high heat resistance.

Further, a metal film or a metal oxide film is stacked on an aluminum alloy film, whereby oxidation of the aluminum alloy film can be prevented. As examples of a material for the metal film or the metal oxide film, titanium, titanium oxide, and the like are given. The above materials are preferable because they are present in large amounts in the Earth's crust and inexpensive to achieve a reduction in the cost of manufacturing an organic EL element.

Then, sealing is performed using a sealant such as a sealing can or a sealing substrate over the second electrode 408 of the organic EL element. Here, a glass substrate is used as a sealing substrate 410, and the substrate 400 and the sealing substrate 410 are attached to each other with an adhesive such as a sealing material to seal a space surrounded by the adhesive.

The space that is sealed is filled with filler or a dried inert gas. Note that an epoxy-based resin is preferably used for the sealing material. A material used for these is desirably a material which does not transmit moisture or oxygen as possible.

As a material used for the sealing substrate, a plastic substrate formed of fiberglass-reinforced plastics (FRP), polyvinyl fluoride (PVF), polyester, acrylic, or the like can be used other than a glass substrate or a quartz substrate. In addition, a desiccant or the like may be put between the substrate and the sealant so that reliability of the light-emitting device is increased. The desiccant removes a minute amount of moisture for sufficient desiccation. For the desiccant, a substance that adsorbs moisture by chemical adsorption such as an oxide of alkaline earth metal, for example, calcium oxide or barium oxide can be used. Note that a substance that adsorbs moisture by physical adsorption such as zeolite or silicagel may also be used.

The desiccant is not necessarily provided, in the case where a sealant is provided in contact with and covering the organic EL element and the outside air is sufficiently shut out.

In the above manner, the organic EL light-emitting body described in this embodiment can be manufactured.

The organic EL light-emitting body may include a dielectric mirror on a surface through which light is extracted. The dielectric mirror is a mirror with wavelength selectivity. In one embodiment of the present invention, the dielectric mirror which reflects light from an LED and transmits light from an organic EL element is provided. When the dielectric mirror is provided on the side through which light from the organic EL light-emitting body is extracted, light from the LED can be reflected off a surface of the organic EL light-emitting body while light from the organic EL light-emitting body is transmitted. Thus, the transmission of light from the LED through the organic EL light-emitting body can be reduced. Accordingly, attenuation of the light from the LED is reduced and thus, a white lighting device with higher efficiency can be manufactured.

The dielectric mirror can be formed in such a manner that two kinds of transparent materials with different refractive indices are alternately stacked, for example. In that case, as the refractive indices of the two kinds of transparent materials are higher or the number of layers is larger, reflection efficiency becomes higher. The stacked-layer structure of the dielectric mirror can be formed by stacking materials selected as appropriate from titanium dioxide, silicon oxide, zinc sulfide, magnesium fluoride, amorphous silicon, silicon nitride, and the like.

As the organic EL light-emitting body included in the white lighting device according to one embodiment of the present invention, a plurality of the organic EL light-emitting bodies 40 described in this embodiment may be arranged in matrix.

With the use of the organic EL light-emitting body described in this embodiment in the white lighting device described in Embodiment 1 or Embodiment 2, a white lighting device with high emission efficiency and directivity can be manufactured.

This embodiment can be combined with any of other embodiments.

This application is based on Japanese Patent Application Ser. No. 2010-249199 filed with Japan Patent Office on Nov. 5, 2010, the entire contents of which are hereby incorporated by reference.

What is claimed is:

1. A lighting device comprising:

a light-emitting diode emitting a first light;

a first light-emitting body emitting a second light, the first light-emitting body comprising a first light-emitting layer;

a second light-emitting body emitting a third light, the second light-emitting body comprising a second light-emitting layer; and a reflector having a reflecting surface, wherein a first dielectric mirror is provided over the first light-emitting body, wherein a second dielectric mirror is provided over the second light-emitting body, wherein the light-emitting diode is provided in a space surrounded by the first light-emitting body, the second light-emitting body, and the reflector, wherein the first light, the second light, and the third light are reflected by any of the first dielectric mirror, the second dielectric mirror, and the reflecting surface of the reflector whereby the first light, the second light, and the third light are converged on a surface to be illuminated, wherein an angle formed by the reflector and the first light-emitting body is greater than or equal to 90° and less than or equal to 150°, and wherein a color of the first light and a color of the second light are complementary colors.

2. The lighting device according to claim 1, wherein a wavelength peak of the first light is greater than or equal to 400 nm and less than or equal to 500 nm.

3. The lighting device according to claim 1, wherein the reflector comprises an organic electroluminescence element.

4. The lighting device according to claim 1, wherein the first light-emitting body comprises a reflective electrode having a visible light reflectance of 60% or more.

5. The lighting device according to claim 1, wherein the first light-emitting body has an uneven surface.

6. The lighting device according to claim 1, wherein the first dielectric mirror reflects the first light and transmits the second light, and wherein the second dielectric mirror reflects the first light and transmits the third light.

7. The lighting device according to claim 1, wherein the lighting device can be folded to be a plane.

8. The lighting device according to claim 1, wherein the first light-emitting layer comprises a first phosphorescent compound.

9. The lighting device according to claim 1, wherein the color of the second light is red to green.

10. A lighting device comprising:

a light-emitting diode emitting a first light;

a first light-emitting body emitting a second light, the first light-emitting body comprising a first light-emitting layer;

a second light-emitting body emitting a third light, the second light-emitting body comprising a second light-emitting layer; and a reflector having a reflecting surface, wherein the first light-emitting body, the second light-emitting body and the reflector are connected to each other to form a part of a pyramid, wherein a first dielectric mirror is provided over the first light-emitting body, wherein a second dielectric mirror is provided over the second light-emitting body, wherein the light-emitting diode is provided in a space surrounded by the first light-emitting body, the second light-emitting body, and the reflector, wherein the first light, the second light, and the third light are reflected by any of the first dielectric mirror, the second dielectric mirror, and the reflecting surface of the reflector whereby the first light, the second light, and the third light are converged on a surface to be illuminated, wherein an angle formed by the reflector and the first light-emitting body is greater than or equal to 90° and less than or equal to 150°, and wherein a color of the first light and a color of the second light are complementary colors.

11. The lighting device according to claim 10, wherein a wavelength peak of the first light is greater than or equal to 400 nm and less than or equal to 500 nm.

12. The lighting device according to claim 10, wherein the reflector comprises an organic electroluminescence element.

13. The lighting device according to claim 10, wherein the first light-emitting body comprises a reflective electrode having a visible light reflectance of 60% or more.

14. The lighting device according to claim 10, wherein the first light-emitting body has an uneven surface.

15. The lighting device according to claim 10, wherein the first dielectric mirror reflects the first light and transmits the second light, and wherein the second dielectric mirror reflects the first light and transmits the third light.

16. The lighting device according to claim 10, wherein the lighting device can be folded to be a plane.

17. The lighting device according to claim 10, wherein the first light-emitting layer comprises a first phosphorescent compound.

18. The lighting device according to claim 10, wherein the color of the second light is red to green.

* * * * *